US008310330B2

(12) United States Patent
Johnson et al.

(10) Patent No.: US 8,310,330 B2
(45) Date of Patent: Nov. 13, 2012

(54) DRY-TYPE TRANSFORMER

(75) Inventors: Charles W. Johnson, Bland, VA (US); Jan Leander, Shanghai (CN); Karel Bilek, Forestlake (AU); Benjamin Weber, Winterberg (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 12/945,261

(22) Filed: Nov. 12, 2010
(Under 37 CFR 1.47)

(65) Prior Publication Data

US 2011/0273259 A1 Nov. 10, 2011

Related U.S. Application Data

(63) Continuation of application No. PCT/EP2008/003820, filed on May 13, 2008.

(51) Int. Cl.
*H01F 27/30* (2006.01)
*H01F 27/28* (2006.01)

(52) U.S. Cl. ..... 336/207; 336/184; 336/185; 336/208; 336/209

(58) Field of Classification Search ..... 336/65, 336/174, 175, 178, 180–183, 184–185, 207–209, 336/210–217
See application file for complete search history.

(56) References Cited

U.S. PATENT DOCUMENTS

| | | | | |
|---|---|---|---|---|
| 1,495,823 | A * | 5/1924 | Underhill | 336/206 |
| 2,783,441 | A * | 2/1957 | Guglielmo et al. | 336/180 |
| 3,748,616 | A * | 7/1973 | Weber et al. | 336/60 |
| 4,238,753 | A | 12/1980 | Bayer | |
| 5,383,266 | A * | 1/1995 | Soter | 29/606 |
| 5,621,372 | A * | 4/1997 | Purohit | 336/60 |
| 6,867,674 | B1 * | 3/2005 | Schutte et al. | 336/180 |
| 2004/0108926 | A1 * | 6/2004 | Hopkinson et al. | 336/5 |
| 2005/0275496 | A1 | 12/2005 | Pauley, Jr. et al. | |

FOREIGN PATENT DOCUMENTS

| | | | |
|---|---|---|---|
| CH | 324509 | A | 9/1957 |
| CH | 487485 | A | 3/1970 |
| DE | 1488794 | A1 | 2/1969 |
| DE | 1948848 | A1 | 4/1971 |
| DE | 3214171 | A | 11/1982 |
| EP | 0056580 | A1 | 7/1982 |
| EP | 0557549 | A | 9/1993 |
| EP | 0557549 | B1 | 8/1995 |
| FR | 2255687 | A | 7/1975 |
| JP | 54131717 | A | 10/1979 |

OTHER PUBLICATIONS

International Search Report (PCT/ISA/210) issued on Apr. 7, 2009, by Japanese Patent Office as the International Searching Authority for International Application No. PCT/EP2008/003820.

* cited by examiner

*Primary Examiner* — Mohamad Musleh
*Assistant Examiner* — Ronald Hinson
(74) *Attorney, Agent, or Firm* — Buchanan Ingersoll & Rooney PC

(57) ABSTRACT

A dry-type transformer includes at least one high-voltage winding and one low-voltage winding. The windings are operatively connected to one another by an electromagnetic field, and each winding is constructed from winding conductors, wherein the high-voltage winding and the low-voltage winding have a defined distance from one another, and spacers are arranged between the windings and maintain the defined distance.

17 Claims, 2 Drawing Sheets

DRY-TYPE TRANSFORMER

RELATED APPLICATION

This application claims priority as a continuation application under 35 U.S.C. §120 to PCT/EP2008/003820 filed as an International Application on May 13, 2008 designating the U.S., the entire content of which is hereby incorporated by reference in its entirety.

FIELD

The present disclosure relates to a dry-type transformer, and to transformers with for example, at least in each case one high-voltage winding and one low-voltage winding, which are operatively connected to one another by an electromagnetic field, each winding being constructed from winding conductors.

BACKGROUND

Transformers can be used in the distribution of electrical energy by transforming AC voltage from a high level to a low voltage level, or vice versa. Conductor windings that are wound around a toroidal iron core, which has a rectangular cross section, can be used for this purpose.

EP 0 557 549 B1 discloses a method for producing a power transformer which is cast with cast resin and has a cut strip-wound core made from a cold-rolled ferro-alloy which has a preferred direction of magnetization, as well as a toroidal-core transformer produced in accordance with this method.

The distance between the high-voltage winding and the low-voltage winding should be maintained to avoid interference effects. Moreover, the insulation between the two windings can be subjected to as high a loading as possible, if the insulation is constructed with as few defects as possible.

The leakage channel of the windings, which includes a region between the high-voltage winding and the low-voltage winding, can be subjected to forces which result in the formation of cracks in the cast. These forces can result from temperature fluctuations.

Furthermore, forces can result from magnetic flux in the leakage channel between the individual turns of the windings. For example, when the clamping pressure of the windings is insufficient in relation to the occurring forces, permanent winding deformations or winding breakages can occur.

SUMMARY

A dry-type transformer is disclosed comprising: at least one high-voltage winding and one low-voltage winding, wherein the windings are operatively connected to one another by an electromagnetic field, and each winding is constructed from winding conductors; and wherein the high-voltage winding and the low-voltage winding have a defined distance from one another, and spacers are arranged between the windings and maintain said defined distance.

A method is disclosed for producing mechanically reinforced spacers is disclosed which are arranged between windings in order to maintain a distance between a high-voltage winding and a low-voltage winding of a dry-type transformer, the method comprising: positioning moldings for producing the spacers at a defined distance from one another, disposing a fiber structure, that mechanically reinforces the spacers and includes high-strength, electrically non-conductive fibers, into contact with the positioned moldings for the spacers; and casting the moldings with a casting compound to at least partially surround and anchor the fiber structure moldings that are positioned at defined distances from one another for the spacers.

BRIEF DESCRIPTION OF THE DRAWINGS

Exemplary embodiments of the disclosure will be described in more detail with reference to the accompanying drawings, in which.

DETAILED DESCRIPTION

Figure 1:
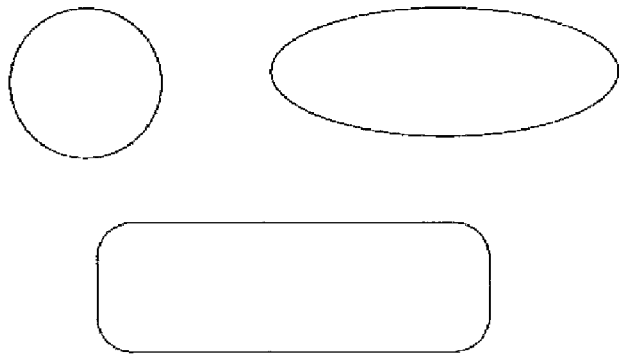
FIG. 1 illustrates a series of various cross-sectional shapes of the spacers in accordance with an exemplary embodiment.

Exemplary embodiments are directed to the design of a dry-type transformer that ensures reliable operation and is not influenced by forces due to temperature or magnetic flux.

Exemplary embodiments disclosed herein can provide a high-voltage winding and low-voltage winding at a defined distance from one another, with spacers disposed between the windings to maintain the distance. The spacers can have sufficient rigidity to prevent interference during operation.

In an exemplary embodiment, the spacers have a cross-sectional shape with no sharp edges and are optimized in terms of processability and operational reliability. The spacers can be provided with a circular cross section or with an oval or rectangular cross section.

The longitudinal edges of the spacers can be provided with a radius.

In another exemplary embodiment, the spacers arranged between the high-voltage winding and the low-voltage winding are mechanically reinforced and connected to one another through a fiber structure.

The fiber structure provided for reinforcing the spacers can be formed by rovings that include high-strength electrically non-conductive fibers or from a woven fabric that includes high-strength electrically nonconductive fibers. In addition, the fiber structure can be formed by a mesh that includes high-strength electrically nonconductive fibers.

In an exemplary embodiment, the fiber structure can be formed from glass fibers, aramid fibers, carbon fibers, or a mixture of these fibers. The thickness of these fiber bundles is only a fraction of the thickness of the spacers, and can be, for example, approximately at a ratio of 1 to 10. That is the fiber bundles can have an exemplary thickness of 1 mm and the spacers can have an exemplary thickness of 10 mm.

In another exemplary embodiment, the fiber structure provided for reinforcing the spacers is integrated at least partially in the spacers, wherein the fibers forming the fiber structure can be introduced locally by being cast or inserted into the spacers, for example.

As discussed herein, an exemplary embodiment includes a method for producing mechanically reinforced spacers, which are arranged between the windings in order to maintain a desired distance between the high-voltage winding and the low-voltage winding of a dry-type transformer.

This method can be characterized by the fact that the moldings provided for producing the spacers are positioned at a defined distance from one another.

Then, the fiber structure which mechanically reinforces the spacers and includes high-strength, electrically nonconductive fibers are brought into contact with the positioned moldings for the spacers for example, the fiber structure can be laid locally onto the moldings and each molding is then virtually closed, by a cover part, which can prevent any leakages during casting of the casting compound.

The casting compound can be cast into the moldings, which are positioned at defined distances from one another for the spacers with the fiber structure, interposed. As a result, the fiber structure can be at least partially surrounded by means of the casting compound with the spacers and anchored therein.

The exemplary embodiments provide that prior to and during the casting of the casting compound high-strength, electrically non-conductive fibers are inserted into the moldings provided for producing the spacers. As a result, the fibers contribute to the mechanical stability of the spacers.

In an exemplary embodiment, mechanical strength of the spacers can be improved based on the material provided as the casting compound. The casting compound located in the moldings can be cured before the moldings are removed from the spacers.

In another exemplary embodiment, the spacers can be inserted between the high-voltage winding and the low-voltage winding as early as during the winding process prior to the application of the high-voltage winding. As a result, forces can be introduced or distributed uniformly, which can prevent the adverse effects of these forces on the winding integrity.

In an exemplary embodiment, the spacers can be manufactured from the same material, which is intended to be used later for the casting of the entire winding. For example, the surface of the spacers can be prepared to achieve the best-possible adhesion of the casting compound on the respective spacer.

In order to control the possible mechanical loads in the region of the leakage channel, an exemplary embodiment can include inserting high-strength fibers in the form of glass rovings or a glass mesh into the cast to mechanically reinforce the windings or the casting compound surrounding the windings.

This reinforcement can be integrated into the spacers. For example, the mechanical reinforcing material can be cast into the spacers at specific distances as well, for example. This casting can result in a glass mesh reinforcement with an integrated spacer.

FIG. 1 illustrates a series of various cross-sectional shapes for the spacers 10 in accordance with an exemplary embodiment. The spacers can be inserted between the winding layers of the high-voltage winding.

These spacers 10 can be introduced between the relevant layers as early as during the production of the winding to ensure that the load distribution or introduction of the load as a result of forces caused by temperature fluctuations or magnetic flux in the leakage channel between the individual turns of the windings can be more uniform.

The cross-sectional shapes of the spacers 10 according to the exemplary embodiments can be those cross-sections which, owing to their shape, can first have a sufficiently high elastic section modulus and secondly can be processed easily when constructing the winding layers. Such shapes do not have any sharp-edged regions at which possible stresses could concentrate, but have a harmonious profile, for example a circular shape or rectangular shape with rounded edge regions or an oval shape. The spacers can be formed from electrically nonconductive, highly resistive fibers, which have sufficient mechanical strength.

The spacers 10 can be produced in elongated moldings, into which the fibers are inserted and then surrounded by a curing casting compound that is introduced into the moldings.

In another exemplary embodiment, the spacers can be produced through a premixed casting compound, which is for example based on synthetic resins such as polyester resin. The premixed casting compound can be first enriched with fibers of different lengths and then subsequently cast into the relevant moldings. In this case, the fibers, which are arranged to be distributed uniformly in the casting compound, form a fiber-reinforced, high-strength spun fabric within the casting compound.

Figure 2:
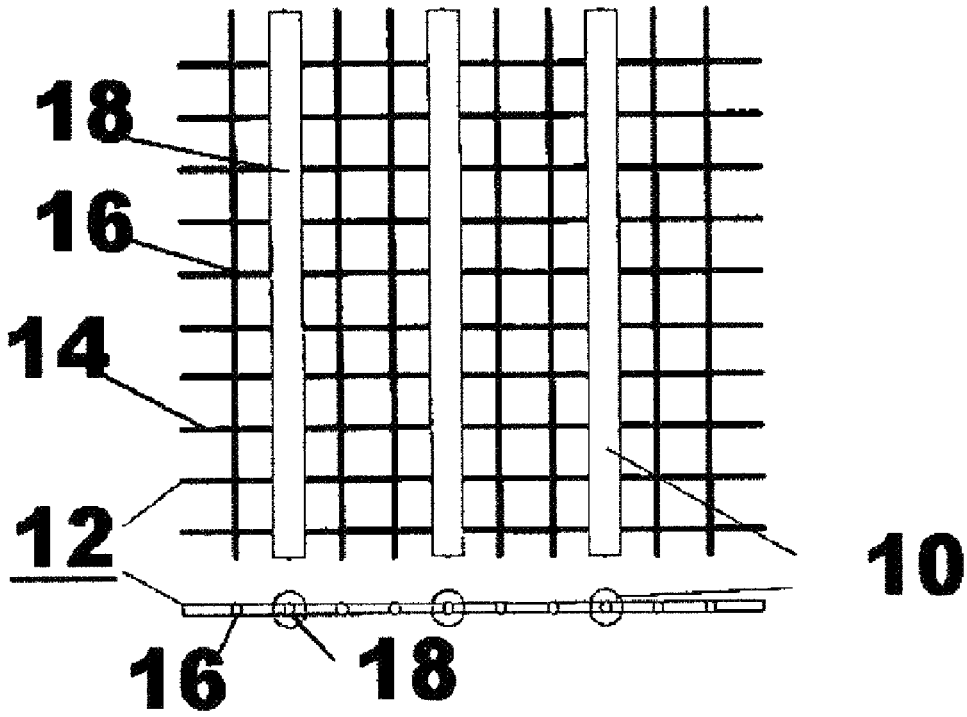
FIG. 2 illustrates an arrangement of spacers which are connected to a mesh-like reinforcing structure of fibers in accordance with an exemplary embodiment.

FIG. 2 illustrates an arrangement of spacers, which are connected in a mesh-like reinforcing structure in accordance with an exemplary embodiment. This arrangement is a variant in which the spacers 10 are arranged parallel to one another, and are connected to one another by means of a network 12 of high-strength nonconductive fibers 14. In this configuration, the spacers 10 provided are those that have a circular cross section.

The mesh-like fiber structure 12 can be connected integrally with the mutually adjacent spacers 10 and thus provide additional reinforcement of the spacers 10 by virtue of the spacers forming a single unit with the fiber bundles 14 adjoining the respective meshes, as a result of the production process.

In order to produce these spacers 10, which are reinforced by the mesh 12, the mesh 12 can be produced from high-strength fibers 14. For each mesh 12 to be assembled with the moldings provided for producing the spacers 10, the mesh 12 are surrounded locally by the casting compound provided for producing the spacers 10 when said casting compound is introduced into the moldings for the spacers 10.

In this regard, FIG. 2 illustrates a side view of an exemplary fiber structure at the top and a plan view or sectional view of an exemplary fiber structure at the bottom. The plan view is at an angle of 90° with respect to the side view.

The plan view shows that the fiber structure can have a substantially unchanged thickness at the points of intersection 16 between the fiber bundles 14 forming the mesh 12, while the spacers 10 have an increased thickness, which is approximately 150% thicker than the mesh-like fiber structure 12, at the points of intersection 18 with the spacers 10.

Figure 3:
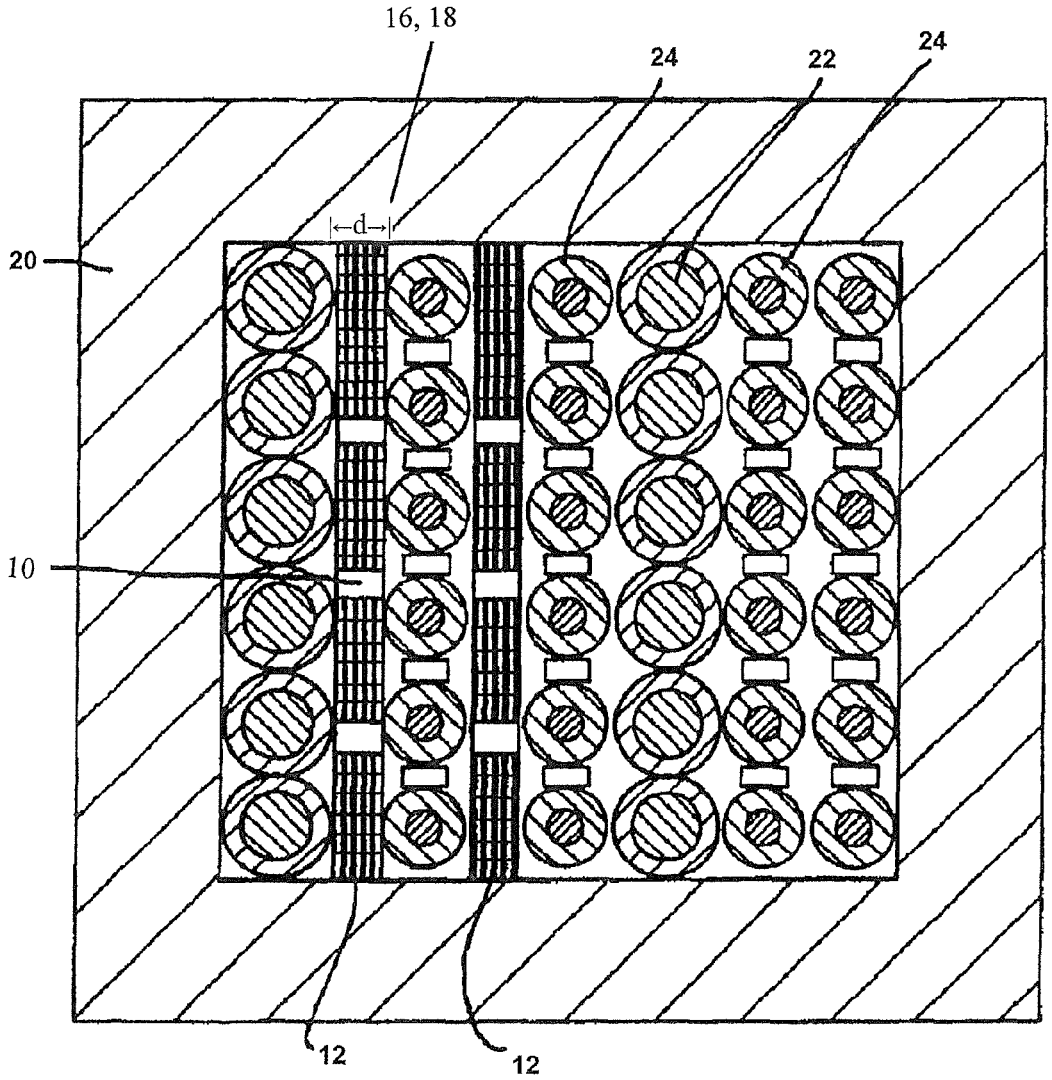
FIG. 3 illustrates a cross-section of an arrangement of low and high voltage windings in accordance with an exemplary embodiment.

FIG. 3 illustrates a cross-section of an arrangement of low and high voltage windings in accordance with an exemplary embodiment. As shown in FIG. 3, a transformer core 20 can have at least one high-voltage winding 24 and at least one low-voltage winding 22. The high-and low-voltage windings being arranged so that they are operatively connected to one another by an electromagnetic field. Each winding is constructed from winding conductors. The high-voltage winding 24 and the low-voltage winding 22 have a defined distance d from one another and spacers 10 are arranged between the windings 22, 24 and maintain the defined distance. The spacers 10 are arranged between the high-voltage winding 24 and the low-voltage winding 22 are mechanically reinforced and connected to one another through a fiber structure 12.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Spacers
12 Mesh, Mesh-like fiber structure
14 Fiber bundles
16 Point of intersection of fiber bundles
18 Point of intersection of fiber bundles with spacers

What is claimed is:

1. A dry-type transformer comprising:

at least one high-voltage winding and one low-voltage winding, wherein the windings are operatively connected to one another by an electromagnetic field, and each winding is constructed from winding conductors;

wherein the high-voltage winding and the low-voltage winding have a defined distance from one another, and spacers are arranged between the windings and maintain said defined distance, and wherein the spacers arranged between the high-voltage winding and the low-voltage winding are mechanically reinforced and connected to one another through a fiber structure.

2. The dry-type transformer of claim 1, wherein the spacers have a cross-sectional shape and no sharp edges.

3. The dry-type transformer of claim 2, wherein the spacers have a circular cross section.

4. The dry-type transformer of claim 2, wherein the spacers have an oval cross section.

5. The dry-type transformer of claim 2, wherein the spacers have a rectangular cross section.

6. The dry-type transformer of claim 5, wherein longitudinal edges of the spacers have a radius.

7. The dry-type transformer of claim 1, wherein the fiber structure reinforces the spacers and is formed by rovings which contain high-strength electrically non-conductive fibers.

8. The dry-type transformer of claim 1, wherein the fiber structure is formed by a woven fabric containing high-strength electrically nonconductive fibers.

9. The dry-type transformer of claim 1, wherein the fiber structure is formed by a mesh containing high-strength electrically nonconductive fibers.

10. The dry-type transformer of claim 1, wherein the fiber structure is formed from glass fibers.

11. The dry-type transformer of claim 1, wherein the fiber structure is formed from aramid fibers.

12. The dry-type transformer of claim 1, wherein the fiber structure is formed from carbon fibers.

13. The dry-type transformer of claim 1, wherein the fiber structure reinforces the spacers and is integrated at least partially into the spacers.

14. The dry-type transformer of claim 13, wherein a casting compound is mixed with fibers which correspond to fibers of the fiber structure that reinforces the spacers.

15. The dry-type transformer of claim 1, wherein the fiber structure is a molded fiber structure, that mechanically reinforces the spacers and includes high-strength, electrically non-conductive fibers.

16. The dry-type transformer of claim 1, wherein each spacer is formed of a mold in which a fiber structure is at least partially surrounded by a casting compound to mechanically reinforce and connect the spacers to one another and anchor the fiber structure of each spacer into positions at defined distances from one another.

17. A dry-type transformer comprising:

at least one high-voltage winding and one low-voltage winding each including winding conductors, wherein the windings are operatively connected to one another by an electromagnetic field; and spacers are arranged between the windings and at a defined distance from one another to maintain the defined distance between the windings, wherein the spacers are molded and include a fiber structure, that mechanically reinforces the spacers and includes high-strength, electrically non-conductive fibers, and wherein the fiber structure is at least partially surrounded by a casting compound to anchor the molded fiber structure of each spacer into positions at defined distances from one another.

* * * * *